US006421936B1

(12) United States Patent
Gerrand

(10) Patent No.: US 6,421,936 B1
(45) Date of Patent: Jul. 23, 2002

(54) SPORTING FOOTWEAR

(76) Inventor: Alan Roy Gerrand, 25 Haldane Street, Beaumaris VIC, 3193 (AU)

( * ) Notice: Subject to any disclaimer, the term of this patent is extended or adjusted under 35 U.S.C. 154(b) by 0 days.

(21) Appl. No.: 09/554,874

(22) PCT Filed: Nov. 23, 1998

(86) PCT No.: PCT/AU98/00970

§ 371 (c)(1),
(2), (4) Date: Jul. 18, 2000

(87) PCT Pub. No.: WO99/26503

PCT Pub. Date: Jun. 3, 1999

(30) Foreign Application Priority Data

| | | |
|---|---|---|
| Nov. 21, 1997 | (AU) | PP0462 |
| Feb. 12, 1998 | (AU) | PP1786 |
| May 19, 1998 | (AU) | PP3562 |
| Jun. 18, 1998 | (AU) | PP4200 |

(51) Int. Cl.[7] ..... A43B 5/00
(52) U.S. Cl. ..... 36/133; 36/71; 36/128
(58) Field of Search ..... 36/133, 71, 132, 36/136, 114, 128

(56) References Cited

U.S. PATENT DOCUMENTS

| | | | | | |
|---|---|---|---|---|---|
| 2,661,547 | A | * | 12/1953 | Hyde et al. | 36/128 |
| 2,796,684 | A | * | 6/1957 | Montgomery | 36/133 |
| 3,350,796 | A | * | 11/1967 | Bealle | 36/128 |
| 3,991,420 | A | * | 11/1976 | Savarino | 36/71 |
| 4,065,861 | A | * | 1/1978 | Pelfrey | 36/133 |
| 4,422,249 | A | * | 12/1983 | Hannah | 36/133 |
| 4,617,746 | A | * | 10/1986 | Hannah | 36/133 |
| 5,437,112 | A | * | 8/1995 | Johnston | 36/133 |
| 5,894,685 | A | * | 4/1999 | Yates | 36/133 |

FOREIGN PATENT DOCUMENTS

| | | | | |
|---|---|---|---|---|
| DE | 3837504 | * | 5/1990 | 36/133 |
| EP | 0 359 081 | | 3/1990 | |
| EP | 0 496 931 A1 | | 5/1991 | |
| GB | 2060351 | * | 5/1981 | 36/133 |
| WO | 96/22712 | | 8/1996 | |

* cited by examiner

*Primary Examiner*—M. D. Patterson
(74) *Attorney, Agent, or Firm*—Merchant & Gould PC

(57) ABSTRACT

Improvements in footwear for sporting purposes requiring the kicking of a ball on or adjacent to an instep of the footwear, there being provided at least one insert (24) for or addition to the footwear which is attachable to the footwear on or adjacent to the instep such that a concave kicking surface (28) is provided, the radius of curvature of the kicking surface (28) being substantially the same as or slightly greater than the radius of the ball, the at least one insert (24) being of a maximum height at the front of the instep at least as great as the maximum height at the rear of the instep.

29 Claims, 10 Drawing Sheets

SPORTING FOOTWEAR

FIELD OF THE INVENTION

This invention relates to footwear for sporting use and refers particularly, though not exclusively, to footwear for sporting use where the footwear is used in the kicking of a ball or the like.

1. Background of the Invention

In sports where a ball is kicked by a player, it is normal to use a shoe or boot to protect the foot of the person kicking the ball. With varying sports, the nature of the shoe or boot varies to allow for the way in which the ball is kicked, and the nature of the ball being kicked. However, in all instances the shoe or boot attempts to follow the inherent shape of a human foot.

The shape of the portion of the human foot which does the kicking generally does not match the shape of the ball. For example, in sports such as Australian rules football, rugby and gridiron the shape of the ball (being an eliptoid) does not match that part of the foot which does the kicking—the instep. To avoid confusion, throughout this specification the instep is the top of the foot and the arch is the underneath of the foot. The top of the instep, when kicking, is inherently convex both longitudinally and laterally and therefore contact with the ball tends to be a narrow band along a portion of the instep. If the ball does not contact the instep correctly, it can skew at an angle, resulting in a less than accurate kick. Also, if it strikes either too high or too low on the instep, the trajectory of the ball will not be that which is desired and the resultant kick will not be as effective as it should, and could, have been.

In sports such as soccer, where a spherical ball is used, the toe of the boot, the instep, and the outside and inside of the foot, are all used for kicking purposes, as is the heel. Again, the problem is that the shape of that portion of the foot being used does not match the ball shape and, therefore, the contact surface is quite limited. This is not always effective in propelling the ball to the desired location and in the desired trajectory.

Although skilled players in the sports can manage to achieve a quite successful result in the majority of occasions, no player has yet been able to achieve the required result every time.

2. Consideration of the Prior Art

In the specification of GB2,060,351A there is disclosed a sports boot having a planar part 11, which is relatively thick, integrally incorporated into the boot 10. This has a planar kicking surface 14 which extends from the toe of the boot over the entire instep to the region of the ankle. Although this provides a planar area and therefore would tend to reduce the number of grossly inaccurate kicks (due to them being slightly off centre on the instep) it does not "cup" the ball to provide accuracy in the kicking. Furthermore, being a relatively thick component, it would not be flexible. As it extends from the toe to the top of the instep, this would mean that a player wearing such a shoe could not walk or run in a normal fashion as the toes would not be able to bend, nor the foot flex, as is required for running. Its sole purpose would be for kicking. It would therefore only be suitable for a place kick in a sport such as rugby. Although this specification discloses that the kicking surface can be slightly concave, it does not disclose the concept of the "cupping" of the ball to provide for great accuracy when kicking.

A further disclosure is in the specification of EP0,359,081A2. Here, there is disclosed a sports shoe having elevations disposed on either side of the instep and extending over the length of the instep. Each elevation has an upper edge which are intended to contact the ball so that the momentum lies between the two contact edges. One of the elevations is of greater height than the other elevation, so that the guidance properties of the shoe would be increased when centre passes are made. Furthermore, the elevations are not of constant height along their length. They commence at a relatively low height at the front of the instep (adjacent the toes) and increase in height along the instep. Therefore, their maximum height and thus accuracy is generated adjacent the ankle of the wearer, rather than at the front position of the instep, which is where most power kicking takes place. Also, the elevations are intended to be placed into pockets formed as an integral part of the upper of the shoe. Furthermore, the ball contacts the edges of the elevations, rather than contacting the upper surface of the elevations and the instep of the foot to provide a cupping effect. A cupping effect imparts far more of the kicking energy to the ball, and provides great guidance of the ball.

It is therefore the principal object of the present invention to provide improvements in footwear for sporting purposes for the use in kicking a ball where a primary contact surface area of the footwear is made to correspond somewhat to the shape of the ball to thus provide a more reliable result when kicking.

BRIEF DESCRIPTION OF THE INVENTION

With the above and other objects in mind, the present invention provides improvements in footwear for sporting purposes requiring the kicking of a ball on or adjacent to an instep of the footwear, there being provided at least one insert for, or addition to, the footwear which is attachable to the footwear on or adjacent to the instep such that a kicking surface is provided and which has a concave upper surface, the radius of curvature of the concave upper surface being substantially the same as, or slightly greater than, that of the ball, the at least one insert being of a maximum height at the front of the instep at least as great as the maximum height at the rear of the instep.

Preferably, the at least one insert has a front surface substantially triangular in shape. More preferably, the front surface is concave, the front surface having a radius of curvature substantially the same as or slightly greater than the radius of curvature of the ball. More preferably, the front surface has an upper peak.

Advantageously, the insert is of relatively constant height along its length.

Furthermore, the at least one insert may have a side surface which is also concave or flat, the radius of curvature of the side surface preferably being the same as or slightly greater than the radius of curvature of the ball.

Advantageously, the at least one insert is integral with the footwear. Alternatively, the at least one insert may be a separate component releasably or securably attachable to the footwear. More advantageously the at least one insert is approximately triangular in vertical cross section. Alternatively, there is one insert which is approximately M-shaped.

BRIEF DESCRIPTION OF THE DRAWINGS

In order that the invention may be fully understood there shall now be described, by way of a non-limitative example only, a preferred construction of an item of footwear incorporating the principal features of the present invention with reference to the accompanying illustrated drawings in which.

Description of preferred embodiments

When playing a ball game such as soccer the player will tend to use different parts of the boot to perform different kicking actions. For example, the side of the ball of the foot, the toe, and the outside of the ball of the foot may be used for small kicks not requiring much power but requiring great control. At this part of the foot there is a great deal of feel and therefore the player will have great control. When a powerful kick is required it is normally the instep of the foot which is used as this allows for great power when kicking, particularly in view of the solid nature of the part of the foot, and the general bony structure beneath the skin. This provides a relatively hard surface underneath the laces of the boot (which are also relatively hard) so that a solid kicking surface is provided to thus impart the maximum kicking energy to the ball to thus project it to the furthest distance possible. Also, by using different parts of the instep, the ball can be directed in different ways, and with different amounts of spin. This is generally the lower portion of the instep rather than the top portion of the instep (nearer the ankle). In addition, the heel of the foot is sometimes used for kicking purposes. In all instances, at these parts of the shoe, modern footwear have what are generally convex surfaces. The ball itself is also convex.

In all drawing figures, where relevant, a portion of a ball is shown in relief.

Figure 1:
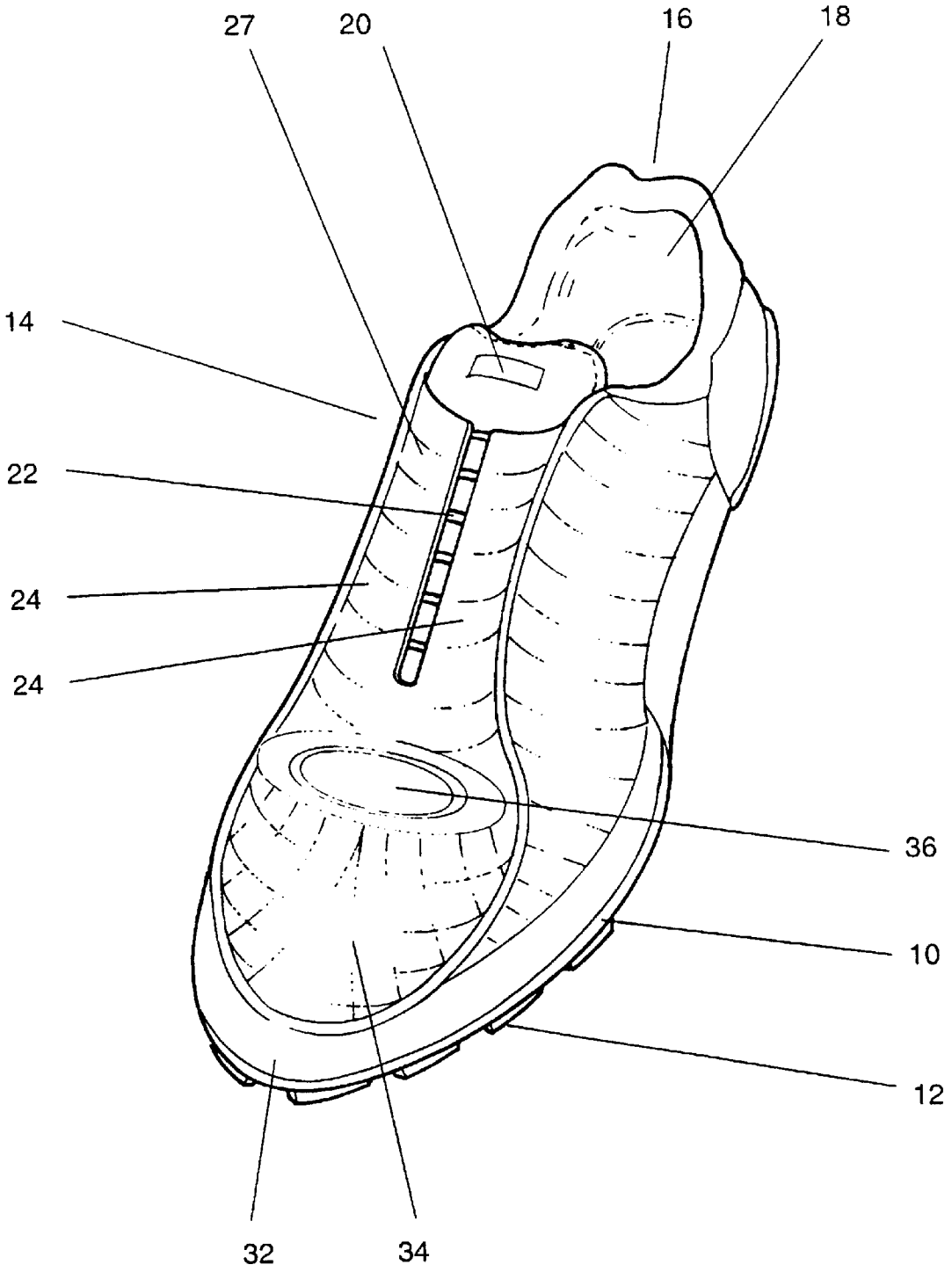
FIG. 1 is a top perspective view of the item of footwear incorporating the principal fees of the present invention.
Figure 2:
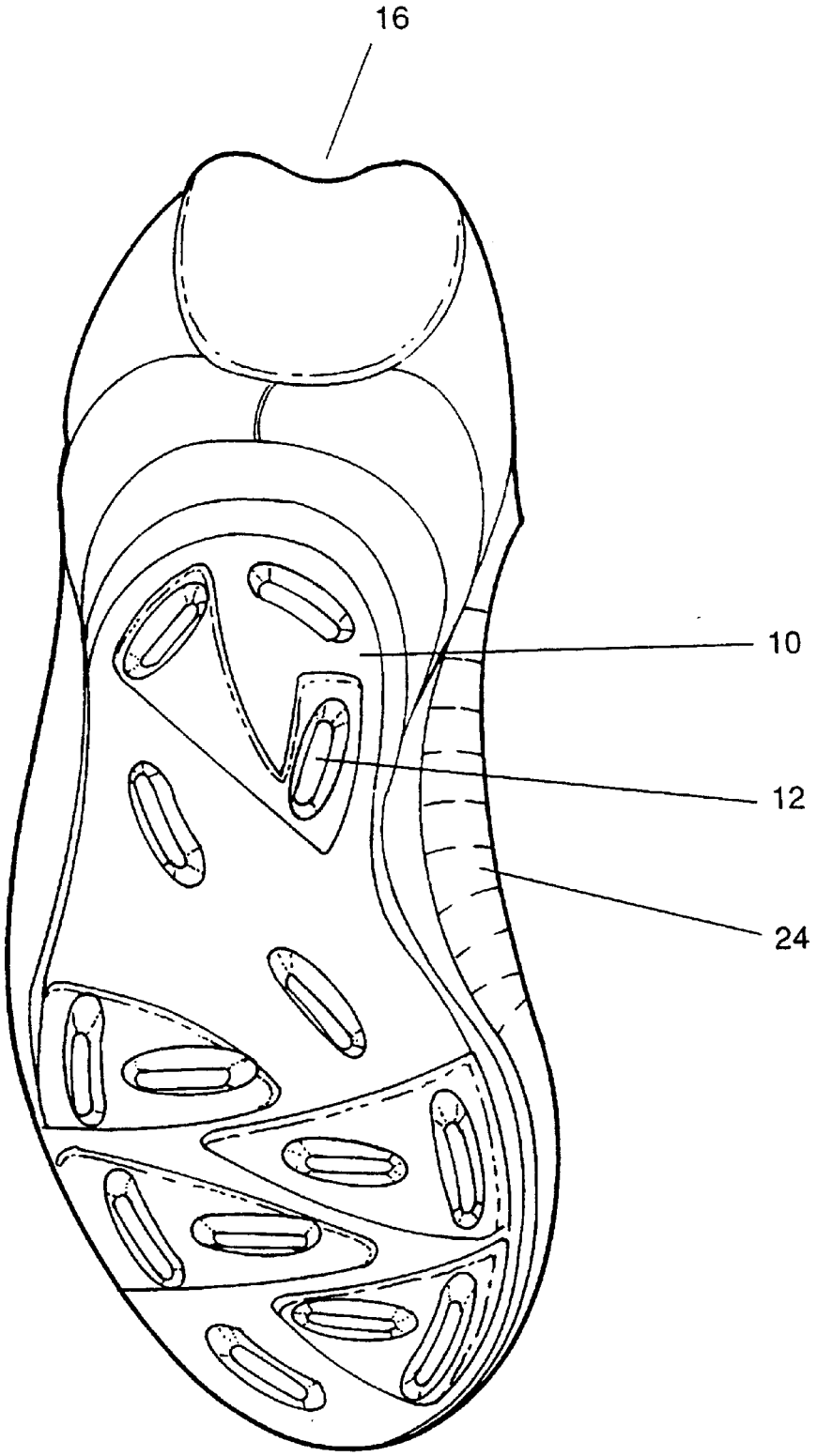
FIG. 2 is a perspective view from the rear and beneath of the item of footwear of FIG. 1.
Figure 3:
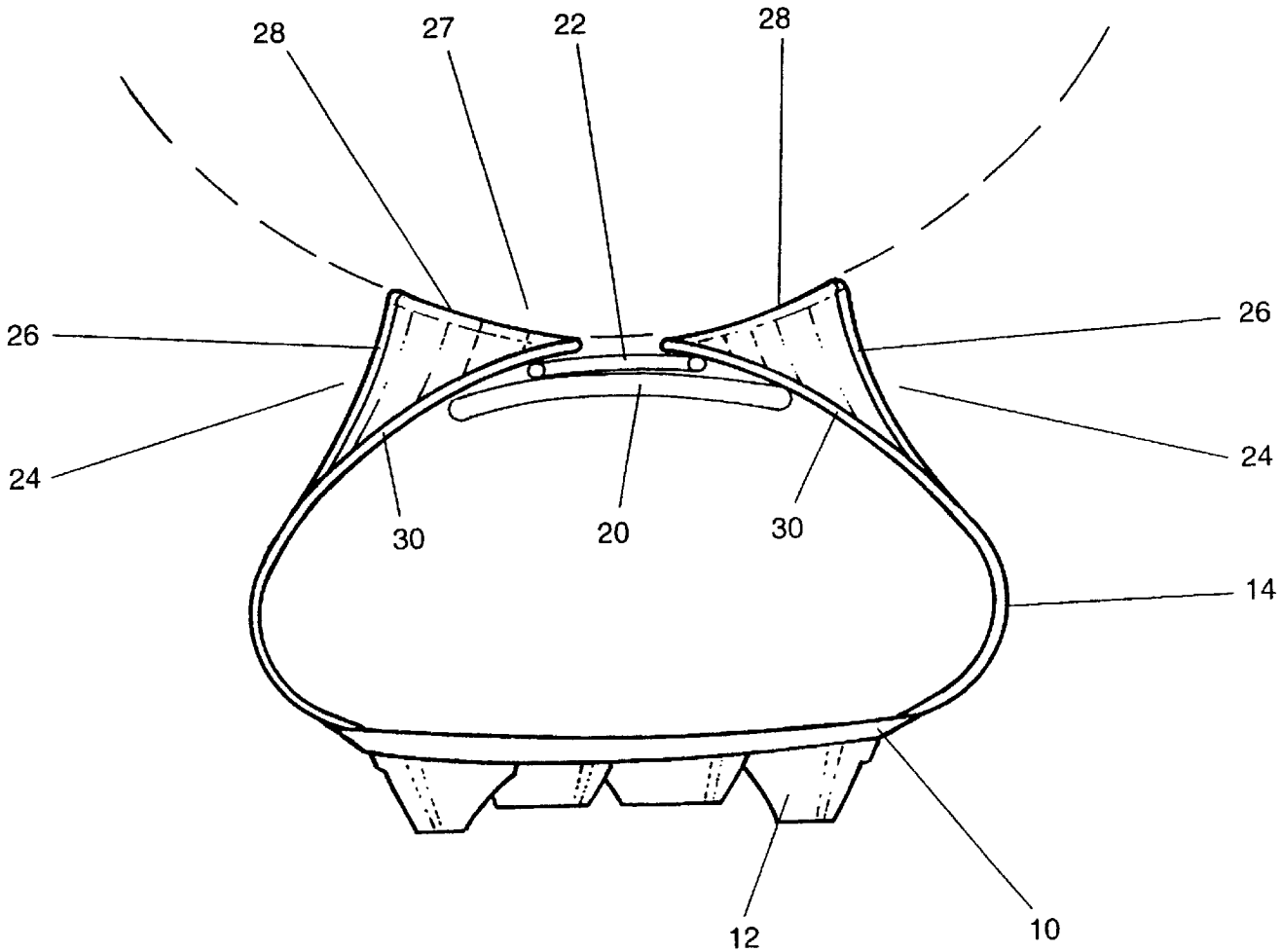
FIG. 3 is a vertical cross sectional view of the item of footwear of FIGS. 1 and 2.

To refer to FIGS. 1 to 3 there is shown a first embodiment of an item of footwear which has a sole 10 having a number of stops, sprigs, or other suitable projections 12 depending therefrom. These are primarily intended to provide grip to the wearer when using the footwear on a playing field.

The shoe has an upper 14 generally of known construction and which has a heel 16, a foot receiving opening 18, and a tongue 20. Laces or the like 22 are provided and which are able to be released to enable the shoe to be placed upon a foot of the wearer, and then tightened to enable the footwear to be retained on the foot of the wearer. The heel 16 is preferably somewhat concave, as is clear from FIG. 2.

Extending longitudinally of the shoe and on either side of the laces 22 are inserts or additions 24 which, in this instance, are integral with the shoe but, as is clear from the earlier description, may be made as separate components which can be releasably or securely attached to the shoe. These are clearly seen in FIG. 3. Each of the inserts 24 is of somewhat triangular configuration and has an outer surface 26 and an upper surface 28. The shape of the outer surfaces 26 and upper surfaces 28 can be varied to accord to the nature of the game being played.

For example, with the game of soccer, the outer surfaces 26 should be curved with a radius of curvature approximating that of a soccer ball. In this way the outer surface 26, together with that part of the upper 14 immediately below the outer surface 26, combines to form a side primary kicking area of a radius substantially the same as or slightly greater than the radius of the ball. Therefore the side primary kicking area is of an area significantly increased over that which has been available before. As the ball is "cupped" improved kicking accuracy to be achieved with the side of the foot. The outer surface 26, and possibly the relevant portion of the upper 14, may be provided with appropriate treatment to enable greater grip on the ball. Therefore, greater spin may be able to be imparted upon the ball, as well as greater distance created, when kicking. insert 24*e* has been made of reduced height. In this way each would have a front surface 40 (not shown on the drawing Figures) and point 42 (again not shown on drawing Figures) of different heights. In this way the effect upon the ball when being kicked would be different on either side of the boot. With the version shown in FIG. 7, a player could kick the ball and with the greater contact area on the left than on the right, and greater effect of the front surface 40 and point 42 on the left rather than the right, the ball would have imparted to it a significant spin in a clockwise direction such that it would tend to curve from left to right as it travelled through the air. This would be of great advantage in the game of soccer, for example, where the left winger could wear such a boot on his right foot and still be able to swing the ball from left to right when kicking towards goal. This is contrary to the normal curve that a player creates when kicking the ball.

Figure 7:
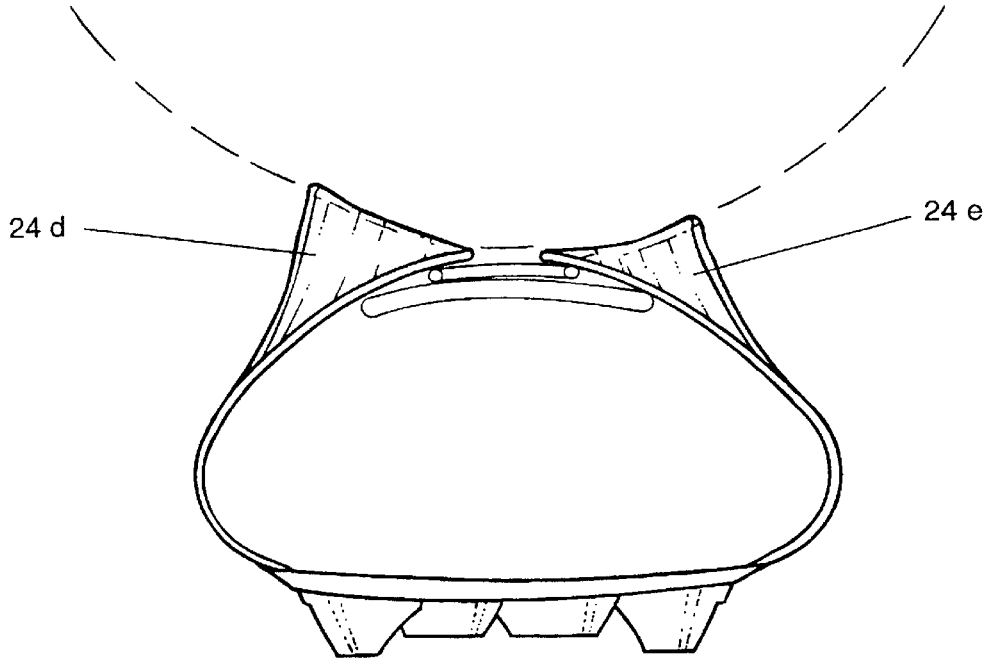
FIG. 7 is a vertical cross-sectional view of a part of an item of footwear as a fifth embodiment of the present invention.
Figure 8:
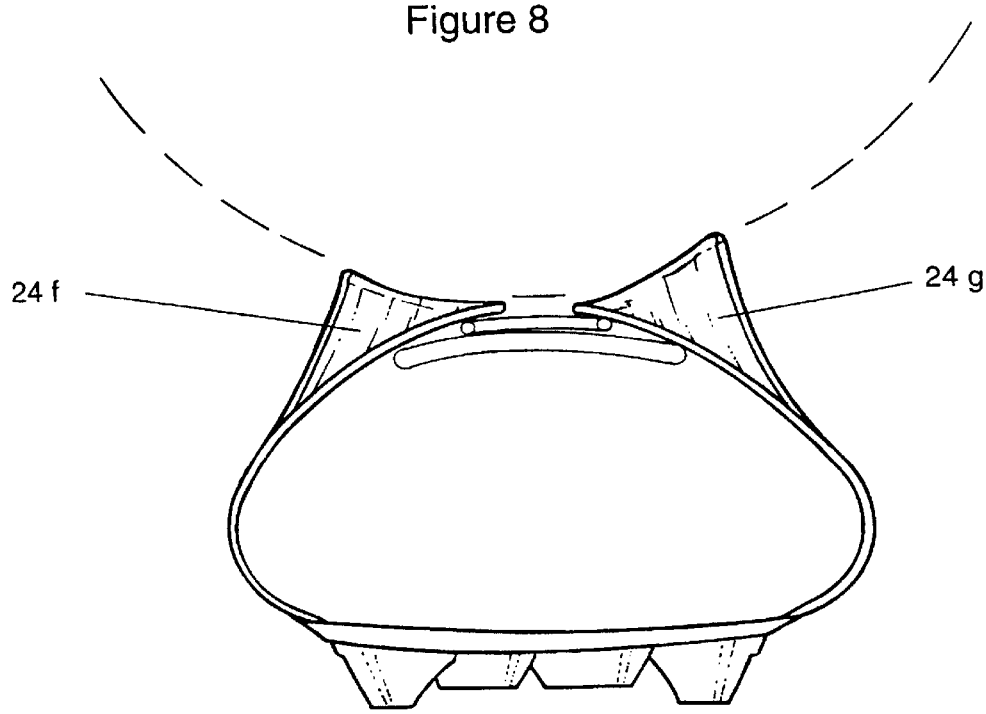
FIG. 8 is a vertical cross-sectional view of a part of an item of footwear as a sixth embodiment of the present invention.

Similarly, the embodiment of FIG. 8 shows a left insert 24 of significantly reduced height, and a right insert 24*g* of increased height. In this way, and using the example of FIG. 7, a player wearing this boot on his right foot would tend to provide great spin on the ball in the anticlockwise direction to thus curve the ball in flight from right to left. This would therefore suit a right winger who could impart great curvature of the ball to be able to swing it towards goal very effectively.

It may be that in games such as rugby when kicking for goal from a place kick a boot such as that shown in FIG. 7, when worn on the left foot of the wearer, would be effective when kicking from the right side of the field to thus provide a ball which would swing towards the centreline and thus be approaching the goal with the greatest opportunity of scoring a goal. Similarly, that of FIG. 8 could be worn on the right foot of a right foot kicking player with a place kick when kicking from the left field to thus reduce the angle that the ball approaches the goal so that it is effectively looking at the complete open goal and thus increase the opportunity of scoring.

Such boots may be provided with an easily reloaded lacing or securing system so that, for example, in a game of rugby a player taking a place kick could very quickly change boots to such a boot design which would have great effect when taking a kick for goal. In the game of rugby, sufficient time is allowed for that.

The region 38 may also be devoid of inserts 24 so that a player will have full flexibility in movement and thus be able to use the shoe in the normal manner when running.

This creates a front edge or surface 40 on each of the inserts 24*a*. As shown, that surface 40 is somewhat triangular at the edge of each insert 24*a*. That triangular surface 40 has an upper peak 42. In conjunction with the surface 34 the surface 40 creates a "cup" effect on the toe of the shoe to thus increase the contact surface area with the ball. It also provides a solid surface, which may impart greater energy from the kick to the ball. It may also enable the ball to have imparted to it more spin by virtue of the contact of the upper peak 42 with the ball.

Figure 5:
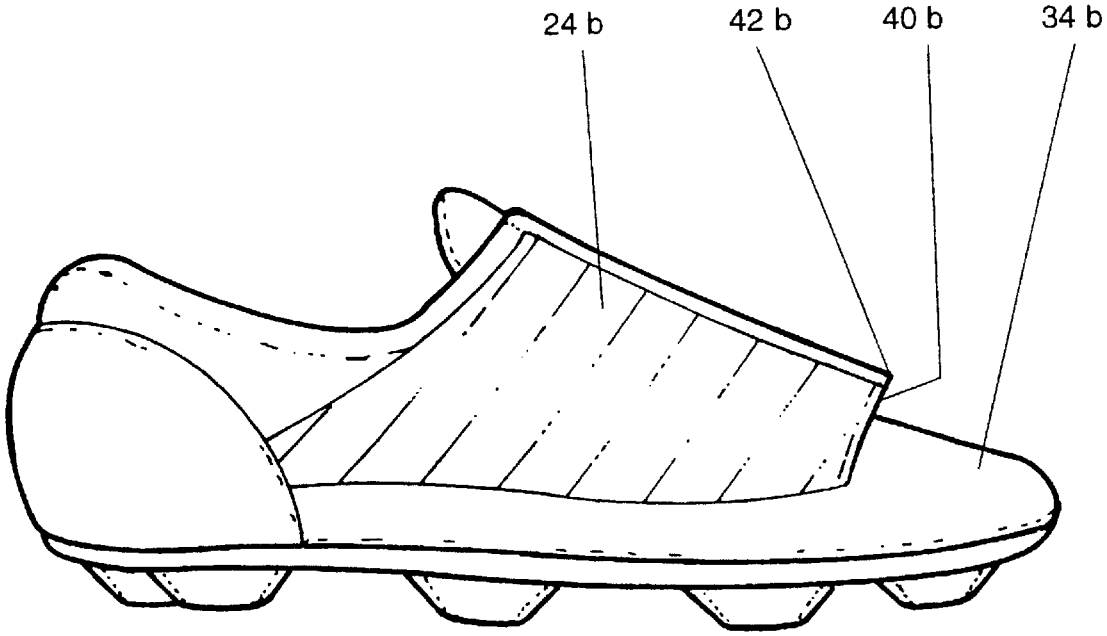
FIG. 5 is a side view of a third embodiment of an item of footwear incorporating principal features of the present invention.
Figure 6:
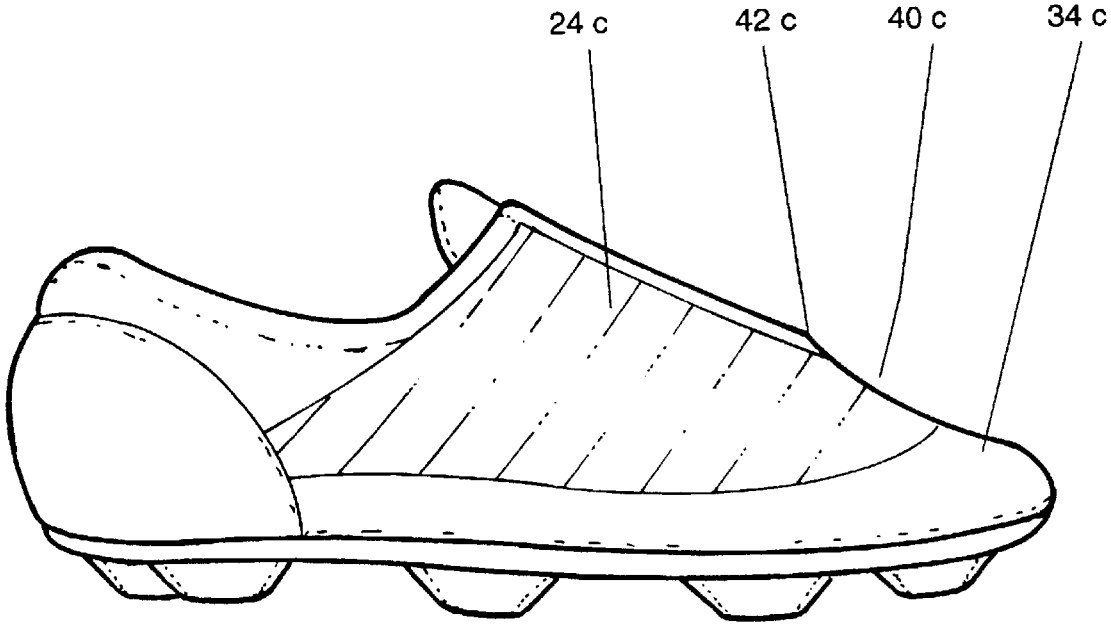
FIG. 6 is a side view of a fourth embodiment of an item of footwear incorporating principal features of the present invention.

This is more illustrated in FIGS. 5 and 6 where, in FIG. 5, inserts 24*b* are shown as having a front surface 40*b* with an upper point 42*b*. As can been seen, the upper peak 42*b* would tend to "dig into" the surface of a ball at the time of kicking and thus be able to provide a greater spin to the ball. With both upper peaks 42*b* able to be used, the player would be able to control the direction of their foot to impart the desired spin. It also provides a concave "cup" on the toe portion 34*b* so that the surface of the ball is contacted by a greater surface area of the shoe.

In FIG. 6, the insert 24*c* has a front surface 40*c* which by itself is somewhat concave. The radius of curvature of surface 40*c* is the same as, or slightly greater than, the radius of curvature of the ball. In this way the "cupping" effect on the ball is significantly increased. However, the upper peak 42*c* still exists and therefore it is still possible to use the upper peak 42*c* to provide an increased ability to spin the ball, and to provide a "ping" when kicking the ball.

This effect can be used to great advantage by varying the heights of the different inserts 24 on either side of the boot. The drawing FIGS. 7 and 8 are views somewhat similar to that of FIG. 3 and are a cross-section looking towards the toe of the shoe.

In FIG. 7 the left insert 24*d* has been made of increased height and the right cause the ball to deviate by several metres over such a distance. This can cause the targeted player to have to move quickly, or may direct the ball to a member of an opposition team. Therefore, at the position on the shoe where power kicking is taking place, the inserts 24 are of full height and therefore provide a full cupping effect. They may taper downwardly in height towards the upper portion of the instep—that nearer the ankle of the wearer—as this is where minimal kicking takes place and, therefore, the inserts may not be required to be of full height.

If desired, that portion immediately above the toes of a wearer, and generally designated as 34, may be of enlarged width and/or of concave shape so that when in a normal kicking position, the foot of the wearer, when combined with the footwear, will again provide an increased primary kicking area to thus increase the efficiency and accuracy of the kicking. A general area 36 known as the primary spot, or sweet spot, which varies in position and/or size according to the game and/or the ball, would also be available. This is because the instep area above the area 36, and the toe region below it, together with inserts 24 provide a large primary kicking surface area in direct contact with the surface of the ball.

The inserts 24 may be parallel, or may diverge, as required.

Naturally, surface treatment may be provided over the exterior surfaces 26, 28 of inserts and/or upper 14 so that greater grip on the ball will be provided at the time of kicking.

Figure 4:
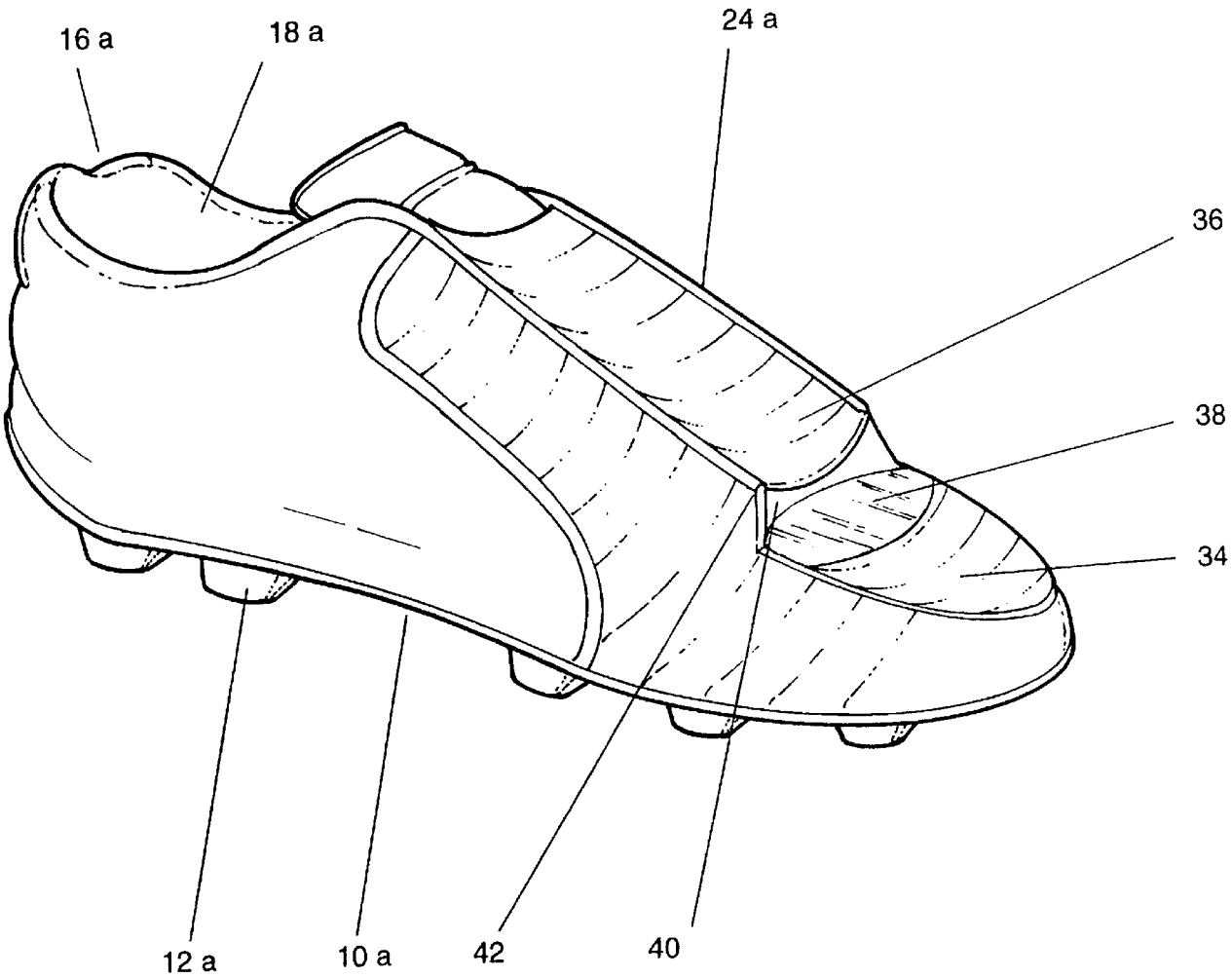
FIG. 4 is a perspective view of a second embodiment of an item of footwear incorporating the principal features of the present invention.

The extent and the shape of the inserts 24 may vary according to the nature of the game being played. As is clear from FIG. 4, the inserts 24*a* are elongated and extend in a more continuous manner along the instep of the shoe to the toe region so as to provide a substantially concave area 36 and which again is of a radius of curvature generally the same as the ball to be kicked. With this form, there may be a region 38 of reduced height of inserts 24 to enable the foot of the wearer to be able to have sufficient flexibility. This form of footwear shown is generally intended for games such as Australian rules football, gridiron or rugby, where an eliptoid ball is used.

As can be seen, the top surface 28 is concave with a radius of curvature the same as or slightly greater than the radius of a soccer ball to enable the ball to locate in and contact the surfaces of the valley 27 created by the top surfaces 28 of the inserts 24 and the lace portion 22 on impact with the shoe, or on deflection off a peak of one insert 24 and thus into the valley 27 on impact with the shoe. The radius of curvature of the top surface 28 of the inserts 24 is the same as or slightly greater than that for a soccer ball. The inserts 24, in combination with the shoe, "cup" the ball on contact with the shoe.

The radius of curvature of sides 26 and upper surfaces 28 needs to be the same as or slightly greater than that of the ball to enable the ball to enter the "valley" created thereby and thus to be "cupped" by the relevant surfaces. If the radius of curvature of the surfaces was less than that of the ball, the ball could not enter the valley and be cupped by the surfaces. It would contact the edges defining therebetween the surfaces, thus reducing the impact surface area. If the radius of curvature of the surfaces was to be significantly greater that the radius of the ball, the ball could contact only part of the concave surface and thus be deflected from the desired trajectory.

The inserts 24 may extend down the upper 14 to the toe region 32 of the shoe. The inserts 24 are of relatively constant vertical cross section throughout their longitudinal extent. It is preferred that the inserts 24 extend along the instep to approximately the front end of the instep. Constant height may not be able to be achieved due to the variations in the shape of the foot of the wearer, which may cause variations in the shape of the upper of the boot. This may therefore cause the inserts 24 to have a slight variation in height along their length. By being of full height at the lower portion of the instep the maximum "cupping" effect on the ball is achieved in that region of the shoe where it is more often required, as this is where most of the "power" kicking is performed. When power kicking is performed, the ball is normally intended to be projected over a large distance. By use of the present invention, greater control over accuracy may be able to be achieved over greater distances. Obviously, if the ball is travelling a distance of 40 or 50 metres, if there is an error of a few degrees at the time of kicking, this will It is preferred that there is an insert 24 on either side of the laces 22. As shown, these are integral with the footwear. However, they may be made as a separate item that can be attached to the footwear by being secured through the lace holes and/or around the shoe, "Velcro", or in any other appropriate manner.

Furthermore, the inserts 24 may be able to be adjustable in height by adding extra layers to the underneath and/or upper surfaces 28 thereof. Also, the nature of the treatment of surfaces 26, 28 may be able to be varied to allow for differing weather or ground conditions, or the style of game to be played. This may be achieved by gluing, screws, clips, "Velcro", straps, or the like.

If desired, the lower surface of each insert 24 may have one or more projections which pass through correspondingly sized and shaped holes in upper 14 to enable direct transference of the "feel" of the ball directly to the foot of a wearer.

The upper 14 of the shoe may have a surface treatment in the form of raised projections on its outer surface. These may be provided in the form of wedges which are separately placed as part of the creation of the surface. These may be integral with the surface (produced during the moulding of the surface,) or be added later. Other forms of surface treatment may be provided such as, for example, by providing a surface which is in the form a series of fine rectangular grids. These are intended to provide greater grip with the surface of the ball when kicking to enable more control over the ball to be exercised. They can also be used to provide greater spin to the ball. This surface treatment may extend over the entire surface area of the shoe, or only the side surfaces of the shoe normally used when kicking the ball. Furthermore, it may be made of a different material such as, for example, a rubber having a tacky or tactile feel to thus be able to grip the ball even more than would be possible without such a surface.

Figure 9:
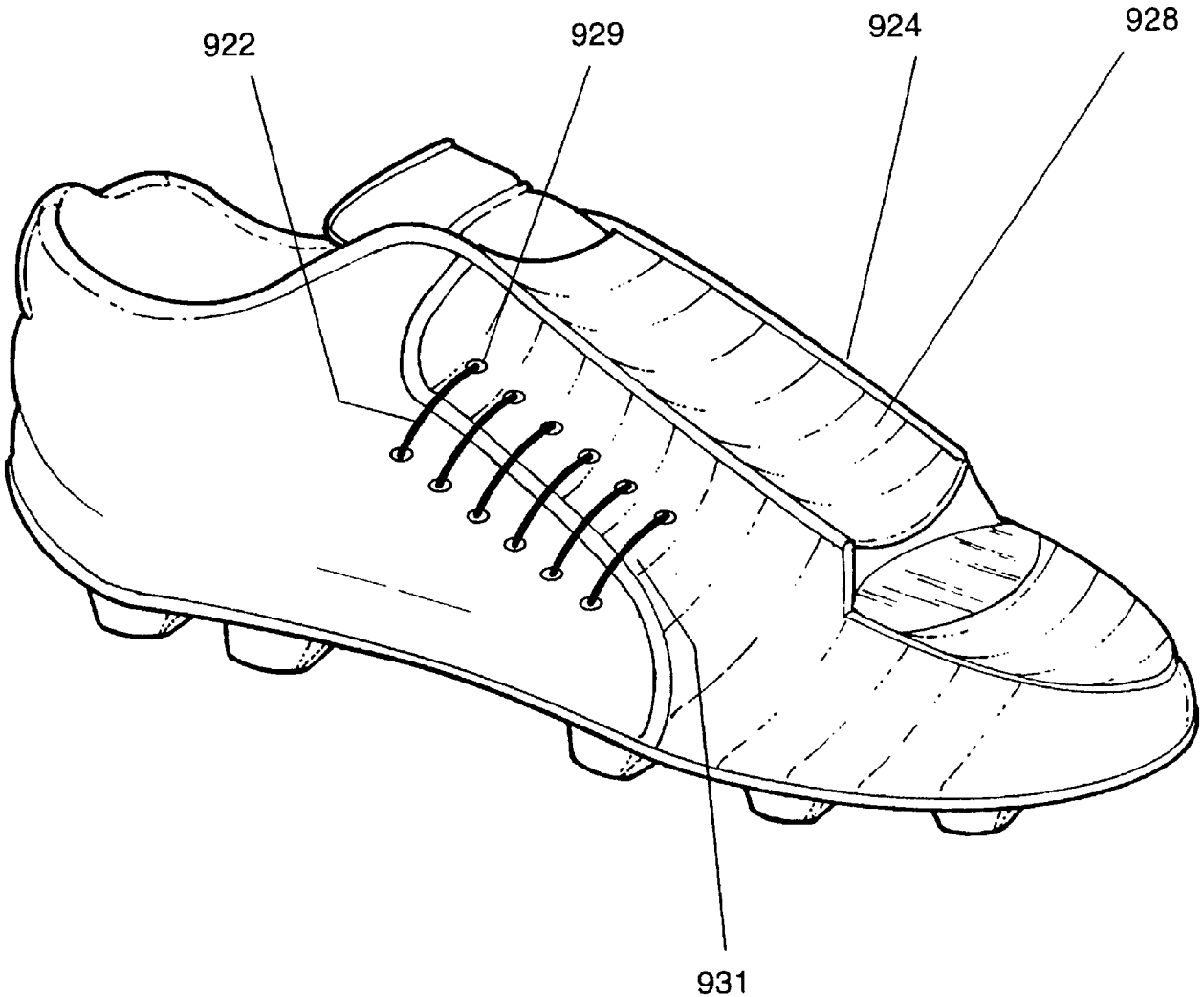
FIG. 9 is a perspective view of seventh embodiment of the present invention.

To now refer to the embodiment of FIG. 9, there is shown an insert which is in the form of a one-piece construction and is generally "M" in shape. Therefore, the upper surface 928 is formed by the insert only. The radius of curvature of the upper surface 928 is the same as or slightly greater than the radius of curvature of the ball to be kicked. As can be seen, the height of the insert 924 is relatively constant along its length and, therefore, at the front of the insert 924 the maximum "cupping" effect is again created so that at that part of the shoe where power kicking takes place, and thus the greatest need for accuracy is created, the greatest degree of accuracy can be provided. In this way the upper surface 928 conforms to the surface of the ball.

This also enables the greatest energy transmission from the foot to the ball to occur. As the shape of the insert upper surface 928 is the same as the shape of the relevant portion of the ball there will be minimal distortion of the outer surface of the ball at the instant of kicking and, therefore, the energy of kicking will be transmitted to the ball in the form of motion rather than distortion of the outer surface of the ball. In that way not only may greater accuracy be achieved, but more distance may also be able to be achieved.

This also applies to the earlier described embodiments.

Also, the embodiment of FIG. 9 may also have the same features at the front surface 940 as shown in FIGS. 5, 6, 7 and 8, and for similar reasons as those described for those embodiments.

In this particular embodiment, by virtue of its nature, the laces 922 are along the side of the insert 924 and therefore a plurality of holes 929 are provided along one edge 931 of the insert 924 so that laces 922 can pass therethrough to enable the shoe to be tightened and loosened in the normal manner.

Figure 10:
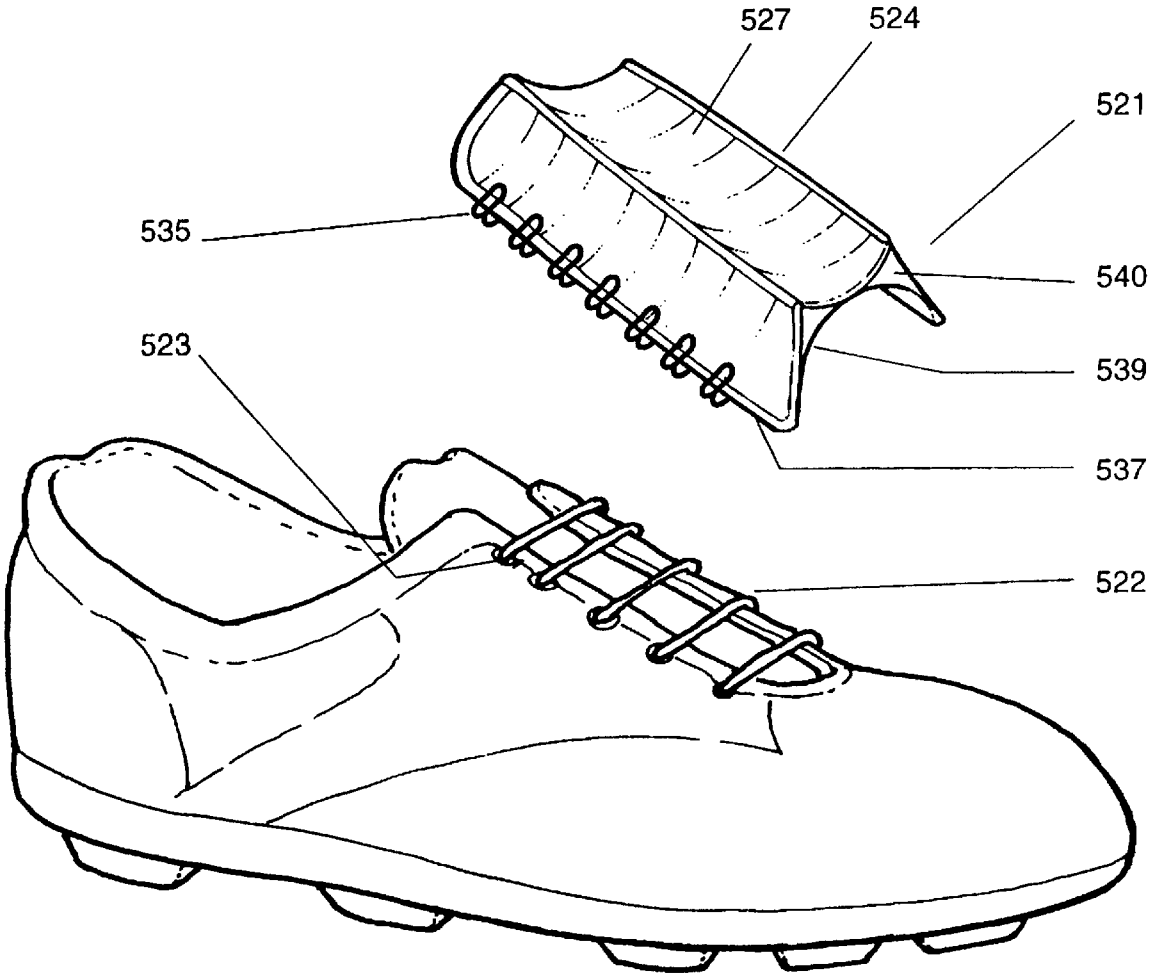
FIG. 10 is an exploded perspective view of an eighth embodiment of the present invention.

To now refer to FIG. 10 there is shown an eighth embodiment in which there is a shoe which is in the form of a conventional football shoe and will therefore not be described in any detail. However, it does have laces 522 which are used to secure the shoe on the foot of a wearer, the laces 522 passing through eyelets 523.

In this form an insert generally designated as 521 which, like that of the embodiment of FIG. 9, is somewhat "M" shape in cross section. It has upper ridges 524 creating a valley 527 which is concave and of a radius the same as or slightly greater than the radius of the ball to be kicked. Again, it has a front surface 540 which again is curved with a radius of curvature the same as or slightly greater than the radius of curvature of the ball.

To secure the insert 521 to the shoe there are a plurality of hooks 535 projecting from either the sides 537 or the undersurface 539 of the insert 521. In this way the hooks 535 can catch in the eyelets 523 to be able to secure the insert 521 to the shoe.

It is preferred that the insert 521 is made of a slightly resilient material so that the insert can be slightly stretched and thus have the hooks 535 under tension when in the eyelets 523. Furthermore, it allows for adjustment for a different separations of the eyelet 523 from one side of the shoe to another depending on the shape of the foot of the wearer.

The hooks 535 can extend from the sides 537, or from the underneath surface 539. They may be variable in length, or may be releasably attachable to the insert 521 to enable persons of different foot shape to have different length hooks so as to accommodate the shape of their foot. The hooks 535 may be upwardly directed (as shown) or may be downwardly directed. They may be attached to the insert by a flexible cord (not shown) which may be of variable length.

The insert 521 may be of solid construction, hollow, or semi-hollow.

Figure 11:
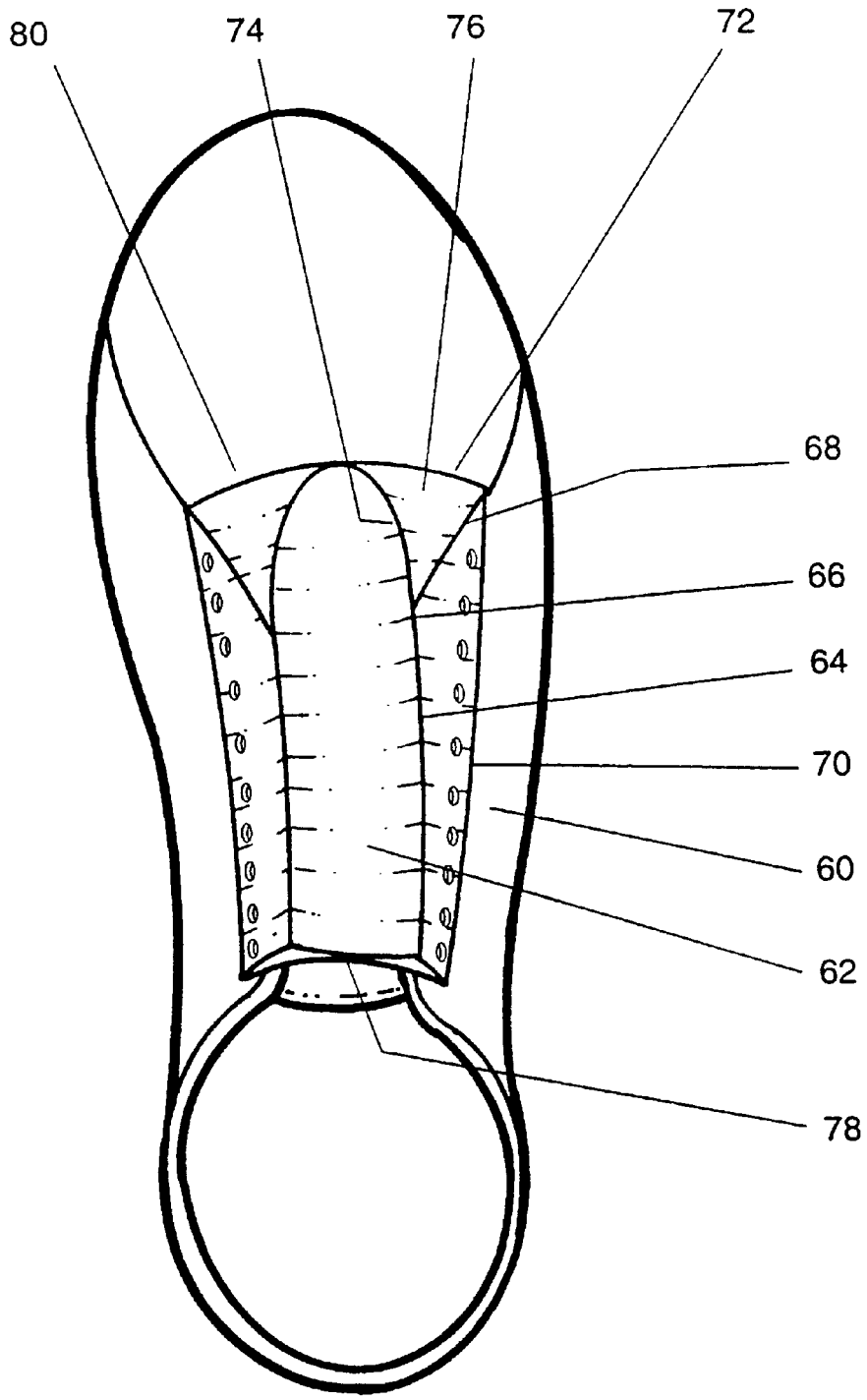
FIG. 11 is a top plan view of ninth embodiment of the present invention.

To refer now to the embodiment of FIGS. 11 through to 13, there is shown a shoe of relatively normal shape having an insert 60 attached or attachable thereto. The insert 60 is of generally the same construction as that of earlier embodiments. In this way, it has a valley 62 of a radius of curvature substantially the same as, or slightly greater than, the radius of curvature of the ball. The valley 62 is created by two ridges 64 extending for the full length of the insert 60. A peak 66 is provided on each side and the ridges 64 tapered downwardly in two directions from the peak 66. The first of these is generally designated as 68 and tapers outwardly to meet with the lower edge 70 of that side of the insert. It tapers to the point where it meets with the edge 70 and also the front edge 72.

The other tapering ridge is generally designated as 74 and tapers downwardly but towards the centre of the valley 62. This therefore creates a triangular area 76 which is somewhat forwardly and somewhat sidewardly facing. This is of great advantage when a ball is desired to be kicked in a manner to provide a great deal of spin but without the necessity for a great deal of power. In this way, the ball can be made to curve. The triangular surface 76 is generally concave in configuration, with the radius of curvature preferably being substantially the same as, or slightly greater than, the radius of curvature of the ball. Naturally, this is repeated on both sides of the insert 60.

The top edge 78 of the insert 60 is somewhat concave, but the lower edge 80 is generally convex, so that the insert will be a snug fit on the shoe.

The "floor" of the valley—that portion between the two ridges 74—will be of relatively low thickness such that the front edge 80 is of minimal thickness.

Figure 12:
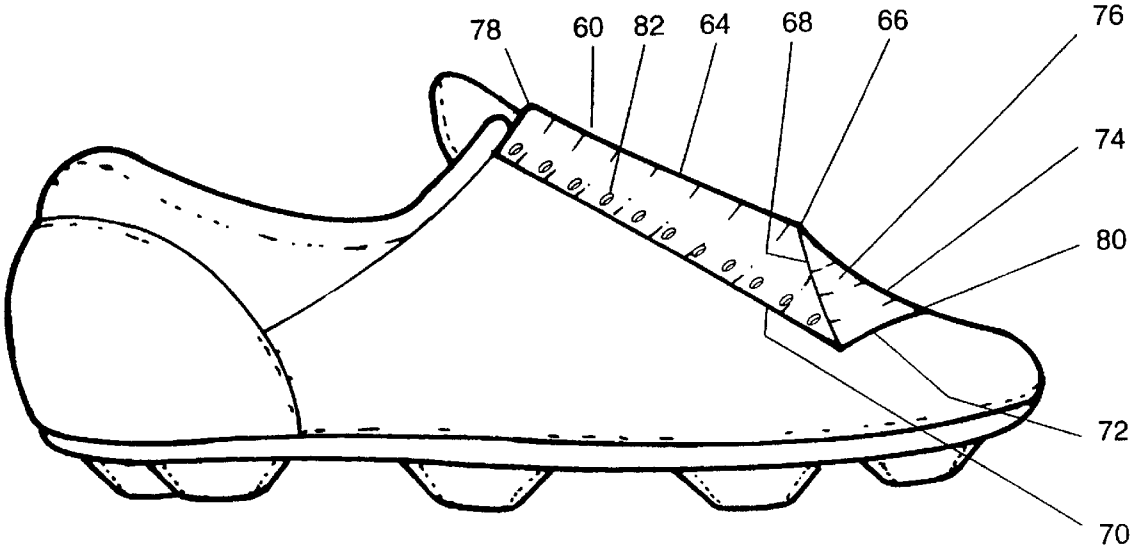
FIG. 12 is a schematic side view of the embodiment of FIG. 11.
Figure 13:
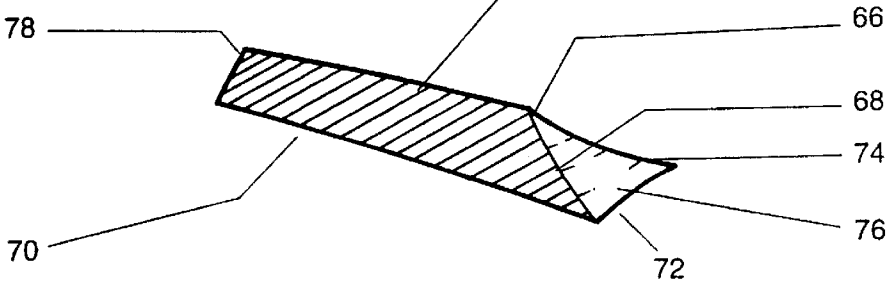
FIG. 13 is partial cross-sectional view of the ninth embodiment.

However, as can be seen from FIGS. 12 and 13, and where FIG. 13 is a cross sectional view along one of the ridges 64, the height or thickness of the insert 60 along a ridge 64 increases towards the front of the insert 60. As an alternative, it can be said to decrease from the front to the rear of the insert. This is so that the "cupping" effect is at the maximum where maximum effect is required.

If desired, a plurality of holes 82 may be provided along each side of the insert 60 adjacent the lower edge 70 for the purposes of placing any shoe laces therethrough.

Along the length of the insert 60, the thickness of the insert at the "floor" of the valley 62 may be minimal, if desired.

It is preferred that the inserts described above be shaped to suit a number of variables:

1. the shape of the human foot;
2. the constant curve or radiature of the various balls used; and
3. the need to have the maximum effectiveness at the correct place along the instep of the foot.

As the shape of the human foot can vary from human to human, and even from a left foot to a right foot on the one person, it may be desired for the insert to be made of constant shape and for there to be filling medium with the ability to absorb the variation in the shape of a foot. This may be created by having the insert made as a hollow structure and with there being the filling medium to fill the hollow structure of the insert and to provide contact with the upper surface of the shoe so that the filling medium can compensate for variations in shape of the human foot, and therefore the variations in shape of the shoe (which will inherently tend to follow the shape of the foot). This may be achieved by using an infill medium such as air (in air sacks or bags), a foam, or a gel which can be set and hardened once in place. The same would apply for the foam—it can be set insitu so that the variation shape can be accommodated. This may be achieved by providing appropriate mechanisms to be able to be used by a user so that the insert can be attached (as in the embodiment of FIG. 9—by use of laces) along one side and placed over and adhered to the upper of the shoe. The air can be added in a similar manner to the known techniques for air-adjustable sports shoes. The gel, foam or the like can be injected, with the appropriate hardener being also injected. This provides the appropriate means by which the foam and its setting or hardening agent can be inserted to fill the void between the insert and the upper of the shoe to create an infill so that the player can then wear the shoe with the insert without any difficulty, and it will be as close as practicable to a perfect fit.

Some players may desire to have a quite hard infill so that the maximum rebound or energy impartation to the ball will be provided. This may be useful for, for example, a goal keeper who is required to provide great distance when kicking. For a striker or the like who may want more control over the ball, a slightly less than hard setting may be able to be achieved by using less setting or hardening agent so that more control of the ball may result.

Therefore, by the ability to mould and then subsequently harden by injection or mixing of hardening agents to achieve the desired and required resilience or hardness/softness it is thereby possible for all forms of football shoes to be made to suit the insert and to allow for a reasonable variation in individual's feet, and the profiles thereof, whilst still having the desired performance effects. This may be able to be used in conjunction with devices other than the insert or for other forms of shoes such as running shoes, shoes for riding bicycles, or other forms of sport shoes, or shoes in general, so that variations in foot shape can be allowed for within the shoe.

It will be understood that the invention disclosed and defined herein extends to all alternative combinations of two or more of the individual features mentioned or evident from the text or drawings. All of these different combinations constitute various alternative aspects of the invention.

It will also be understood that where the term "comprises" or its grammatical variants, is employed herein, it is equivalent to the term "includes" and is not to be taken as excluding the presence of other elements or features.

What is claimed is:

1. A sports shoe, of the type generally worn in football, rugby and soccer style sports, comprising an upper, the upper comprising a toe region, the upper comprising an instep comprising a pair of longitudinally extending spaced apart ridges, the ridges comprising front ends disposed behind said toe region and rear ends disposed behind said front ends, said shoe further comprising a generally concave valley extending between said ridges rearwardly from behind said toe region, said valley having a transversely curved cross-section, said valley being configured to cup a ball that contacts said instep, said upper comprising said toe region, said toe region being disposed ahead of said front ends and said concave valley, said toe region having a reduced height lower than a height of said ridges, said reduced height facilitating flexibility of said shoe in said toe region.

2. A shoe according to claim 1, wherein said ridges are at least as high at said front ends as at said rear ends.

3. A shoe according to claim 2, wherein said ridges diverge proximate said toe region.

4. A shoe according to claim 1, wherein said ridges diverge proximate said toe region.

5. A shoe according to claim 1, wherein said ridges and said valley are integral with said upper.

6. A shoe according to claim 1, further comprising fastening means such that said ridges and said valley are releasably attachable to said upper.

7. A shoe according to claim 6, wherein said fastening means comprise shoelace holes.

8. A shoe according to claim 6, wherein said fastening means comprise hook-and-loop fasteners.

9. A shoe according to claim 1, wherein said ridges and said valley comprise a single component, and further comprising fastening means such that said single component is releasably attachable to said upper.

10. A shoe according to claim 9, wherein said fastening means comprise hook-and-loop fasteners.

11. A shoe according to claim 9, wherein said fastening means comprise shoelace holes.

12. A shoe according to claim 9, wherein said single component comprises sides, and said fastening means are disposed along each side of said single component.

13. A shoe according to claim 9, wherein said single component comprises sides, and said fastening means are disposed along one side of said single component.

14. A shoe according to claim 9, wherein said single component is hollow, and comprises a filling medium disposed within said single component.

15. A shoe according to claim 1, wherein said ridges are of substantially constant height between said front ends and said rear ends.

16. A shoe according to claim 15, wherein said toe region is concave and comprises a transversely curved cross-section configured to cup a ball.

17. A shoe according to claim 1, wherein said ridges comprise concave side surfaces each comprising a curved cross-section configured to cup a ball.

18. A shoe according to claim 1, wherein said toe region is concave and comprises a transversely curved cross-section configured to cup a ball.

19. A shoe according to claim 1, wherein a height of said ridges varies transversely across said instep such that said ridges are adapted for imparting a curved trajectory to a ball.

20. A sports shoe, of the type generally worn in football, rugby and soccer style sports, comprising: an upper, the upper comprising a toe region, the upper comprising an instep comprising a pair of longitudinally extending spaced apart ridges, the ridges comprising front ends disposed behind said toe region and rear ends disposed behind said front ends, said shoe further comprising a generally concave valley extending between said ridges rearwardly from configured to cup a ball that contacts said instep, each of said ridges comprising front surfaces comprising upper peaks at said front ends of said ridges said upper comprising said toe region, said toe region being disposed ahead of said front ends and said concave valley, said toe region having a reduced height lower than a height of said ridges, said reduced height facilitating flexibility of said shoe in said toe region.

21. A shoe according to claim 20, wherein said front surfaces are generally triangular in shape.

22. A shoe according to claim 21, wherein said ridges are generally triangular in cross-section.

23. A shoe according to claim 20, wherein said front surfaces are concave and comprise a transversely curved cross-section configured to cup a ball.

24. A sports shoe, of the type generally worn in football, rugby and soccer style sports, comprising: an upper, the upper comprising a toe region, the upper comprising an instep comprising a pair of longitudinally extending spaced apart ridges, the ridges comprising front ends disposed behind said toe region and rear ends disposed behind said front ends, said shoe further comprising a generally concave valley extending between said ridges rearwardly from behind said to region, said valley having a transversely curved cross-section, said valley being configured to cup a ball that contacts said instep, each of said ridges comprising front surfaces comprising upper peaks at said front ends of said ridges said upper comprising said toe region, said front surfaces being generally triangular in shape, said toe region being disposed ahead of said front ends and said concave valley, said toe region having a reduced height lower than a height of said ridges, said reduced height facilitating flexibility of said shoe in said toe region.

25. A shoe according to claim 24, wherein said ridges are generally triangular in cross-section.

26. A sports shoe, of the type generally worn in football, rugby and soccer style sports, comprising: an upper, the upper comprising a toe region, the upper comprising an instep comprising a pair of longitudinally extending spaced apart ridges, the ridges comprising front ends disposed behind said toe region and rear ends disposed behind said front ends, said ridges diverging proximate said toe region, said shoe further comprising a generally concave valley extending between said ridges rearwardly from behind said to region, said valley having a transversely curved cross-section, said valley being configured to cup a ball that contacts said instep, said upper comprising said toe region, said toe region being disposed ahead of said front ends and said concave valley, said toe region having a reduced height lower than a height of said ridges, said reduced height facilitating flexibility of said shoe in said toe region.

27. A sports shoe, of the type generally worn in football, rugby and soccer style sports, comprising: an upper, the upper comprising a toe region, the upper comprising an instep comprising a pair of longitudinally extending spaced apart ridges, the ridges comprising front ends disposed behind said toe region and rear ends disposed behind said front ends, said ridges being at least as high at said front ends as at said rear ends, said ridges diverging proximate said toe region, said shoe further comprising a generally concave valley extending between said ridges rearwardly from behind said to region, said valley having a transversely curved cross-section, said valley being configured to cup a ball that contacts said instep, said upper comprising said toe region, said toe region being disposed ahead of said front ends and said concave valley, said toe region having a reduced height lower than a height of said ridges, said reduced height facilitating flexibility of said shoe in said toe region.

28. A sports shoe, of the type generally worn in football, rugby and soccer style sports, comprising: an upper, the upper comprising a toe region, the upper comprising an instep comprising a pair of longitudinally extending spaced apart ridges, the ridges comprising front ends disposed behind said toe region and rear ends disposed behind said front ends, said shoe further comprising a generally concave valley extending between said ridges rearwardly from behind said to region, said valley having a transversely curved cross-section, said valley being configured to cup a ball that contacts said instep, said ridges and said valley comprising a single component, said single component comprising fastening means such that said single component is releasably attachable to said upper, said single component being hollow and comprising a filling medium disposed within said single component, said upper comprising said toe region, said toe region being disposed ahead of said front ends and said concave valley, said toe region having a reduced height lower than a height of said ridges, said reduced height facilitating flexibility of said shoe in said toe region.

29. A sports shoe, of the type generally worn in football, rugby and soccer style sports, comprising: an upper, the upper comprising a toe region, the upper comprising an instep comprising a pair of longitudinally extending spaced apart ridges, the ridges comprising front ends disposed behind said toe region and rear ends disposed behind said front ends, said ridges comprising concave side surfaces each comprising a curved cross-section configured to cup a ball, said shoe further comprising a generally concave valley extending between said ridges rearwardly from behind said to region, said valley having a transversely curved cross-section, said valley being configured to cup a ball that contacts said instep, said upper comprising said toe region, said toe region being disposed ahead of said front ends and said concave valley, said toe region having a reduced height lower than a height of said ridges, said reduced height facilitating flexibility of said shoe in said toe region.

* * * * *